US007670108B2

(12) United States Patent
Liang

(10) Patent No.: US 7,670,108 B2
(45) Date of Patent: Mar. 2, 2010

(54) AIR SEAL UNIT ADAPTED TO BE POSITIONED ADJACENT BLADE STRUCTURE IN A GAS TURBINE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 579 days.

(21) Appl. No.: 11/602,518

(22) Filed: Nov. 21, 2006

(65) Prior Publication Data

US 2008/0118346 A1 May 22, 2008

(51) Int. Cl.
*F01D 5/08* (2006.01)

(52) U.S. Cl. ..... 415/173.1; 415/115; 415/116; 415/173.4; 415/178

(58) Field of Classification Search ..... 415/115, 415/116, 173.1, 173.4, 176, 178
See application file for complete search history.

(56) References Cited

U.S. PATENT DOCUMENTS 4,529,358 A 7/1985 Papell
4,679,981 A * 7/1987 Guibert et al. ..... 415/116
5,375,973 A * 12/1994 Sloop et al. ..... 415/173.1
5,538,393 A * 7/1996 Thompson et al. ..... 415/115
6,102,654 A 8/2000 Oeynhausen et al.
6,120,249 A 9/2000 Hultgren et al.
6,617,003 B1 * 9/2003 Lee et al. ..... 428/131
6,702,547 B2 3/2004 Tiemann
6,705,832 B2 3/2004 Tiemann
6,905,302 B2 * 6/2005 Lee et al. ..... 415/115
6,916,150 B2 7/2005 Liang
7,033,138 B2 4/2006 Tomita et al.
2005/0067788 A1 3/2005 Liang
2005/0265837 A1 12/2005 Liang
2005/0281667 A1 12/2005 Liang
2006/0056967 A1 3/2006 Liang
2006/0123797 A1 6/2006 Zborovsky et al.

* cited by examiner

*Primary Examiner*—Igor Kershteyn

(57) ABSTRACT

An air seal unit to be positioned adjacent blade structure in a gas turbine is provided. The air seal unit comprises a main body including a plurality of first impingement cavities and at least one first interconnecting passage extending between and communicating with a first pair of the first impingement cavities. The first interconnecting passage is nonparallel to the first pair of the first impingement cavities and defines a path for cooling air to pass from one impingement cavity of the first pair of the first impingement cavities to another impingement cavity of the first pair of the first impingement cavities so as to strike a wall defining at least a part of the other impingement cavity of the first pair of the first impingement cavities.

20 Claims, 6 Drawing Sheets

AIR SEAL UNIT ADAPTED TO BE POSITIONED ADJACENT BLADE STRUCTURE IN A GAS TURBINE

FIELD OF THE INVENTION

The present invention is directed to an air seal unit forming part of an outer air seal structure adapted to be positioned adjacent blade structure in a gas turbine.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gas travels to the turbine. Within the turbine are a series of rows of stationary vanes and rotating blades. Each pair of rows of vanes and blades is called a stage. Typically, there are four stages in a turbine. The rotating blades are coupled to a shaft and disc assembly. As the working gas expands through the turbine, the working gas causes the blades, and therefore the shaft and disc assembly, to rotate.

It is known to provide an outer air seal structure positioned about and adjacent a row of blades in a gas turbine. One such outer air seal structure is disclosed in U.S. Pat. No. 7,033,138 B2, the disclosure of which is incorporated herein by reference. The seal structure comprises a plurality of cooling conduits defining paths through which cooling air passes from a top surface of the seal structure to outer edges of the seal structure. The cooling air functions to cool the seal structure as it passes through the cooling conduits.

It would be advantageous to provide a seal structure which allows for improved cooling of the seal structure.

SUMMARY OF THE INVENTION

In accordance with a first aspect of the present invention, an air seal unit adapted to be positioned adjacent blade structure in a gas turbine is provided. The air seal unit comprises a main body having a front edge, a rear edge, first and second side edges, an upper surface and a lower surface. The lower surface is adapted to be positioned adjacent blade structure in a gas turbine. The main body includes a plurality of first impingement cavities and at least one first interconnecting passage extending between and communicating with a first pair of the first impingement cavities. The first interconnecting passage is nonparallel to the first pair of the first impingement cavities and defines a path for cooling air to pass from one impingement cavity of the first pair of the first impingement cavities to another impingement cavity of the first pair of the first impingement cavities so as to strike a wall defining at least a part of the other impingement cavity of the first pair of the first impingement cavities.

The air seal unit may further comprise at least one cooling air supply bore communicating with the one first impingement cavity.

The at least one first interconnecting passage may comprise a plurality of first interconnecting passages. A first group of the first interconnecting passages may extend between the first pair of the first impingement cavities and a second group of the first interconnecting passages may extend between a second pair of the first impingement cavities. The second pair of the first impingement cavities may include an impingement cavity from the first pair of the first impingement cavities. Preferably, the first group of the first interconnecting passages may be staggered relative to the second group of the first interconnecting passages.

The first interconnecting passages may be generally perpendicular to the first impingement cavities.

The first impingement cavities and the first interconnecting passages may be located in a first cooling zone of the main body. The main body may further comprise a second cooling zone. The second cooling zone may comprise a plurality of second impingement cavities and at least one second interconnecting passage extending between and communicating with a pair of the second impingement cavities.

Preferably, alternating ones of the first impingement cavities extend to and have exits at the first side edge of the main body while the remaining ones of the first impingement cavities between the alternating ones extend to and have exits at the second side edge of the main body.

A first interconnecting passage may have a diameter which is less than a diameter of each of the first impingement cavities.

The air seal unit may further comprise a plurality of rear cooling bores extending from one of the first impingement cavities to the main body rear edge.

In accordance with a second aspect of the present invention, a gas turbine is provided including rotatable blade structure and an outer air seal structure positioned about and adjacent the blade structure. The air seal structure may comprise a plurality of air seal units. At least one of the units may comprise a main body having a front edge, a rear edge, first and second side edges, an upper surface and a lower surface. The lower surface is adapted to be positioned adjacent the blade structure. The main body may comprise first and second cooling zones. The first cooling zone may include a plurality of first impingement cavities and a plurality of first interconnecting passages and the second cooling zone may include a plurality of second impingement cavities and a plurality of second interconnecting passages. At least one of the first interconnecting passages may extend between and communicate with a first pair of the first impingement cavities and at least one of the second interconnecting passages may extend between and communicate with a first pair of the second impingement cavities. The one first interconnecting passage is preferably nonparallel to the first pair of the first impingement cavities and the one second interconnecting passage is preferably nonparallel to the first pair of the second impingement cavities.

The air seal unit may further comprise at least one first cooling air supply bore communicating with one first impingement cavity and at least one second cooling air supply bore communicating with one second impingement cavity.

A first group of the first interconnecting passages may extend between the first pair of the first impingement cavities and a second group of the first interconnecting passages may extend between a second pair of the first impingement cavities. The second pair of the first impingement cavities may include an impingement cavity from the first pair of the first impingement cavities. The first group of the first interconnecting passages may be staggered relative to the second group of the first interconnecting passages.

A number of the first impingement cavities may not equal a number of the second impingement cavities.

A size of each of the first impingement cavities may be different from a size of each of the second impingement cavities.

Alternating ones of the first impingement cavities may extend to and have exits at the first side edge of the main body while the remaining ones of the first impingement cavities between the alternating ones may extend to and have exits at the second side edge of the main body.

At least one resupply bore may extend from the upper surface of the main body to one of the first or second impingement cavities.

A plurality of front cooling bores may extending from one of the second impingement cavities to the main body front edge and a plurality of rear cooling bores may extend from one of the first impingement cavities to the main body rear edge.

DETAILED DESCRIPTION OF THE INVENTION

Figure 1:
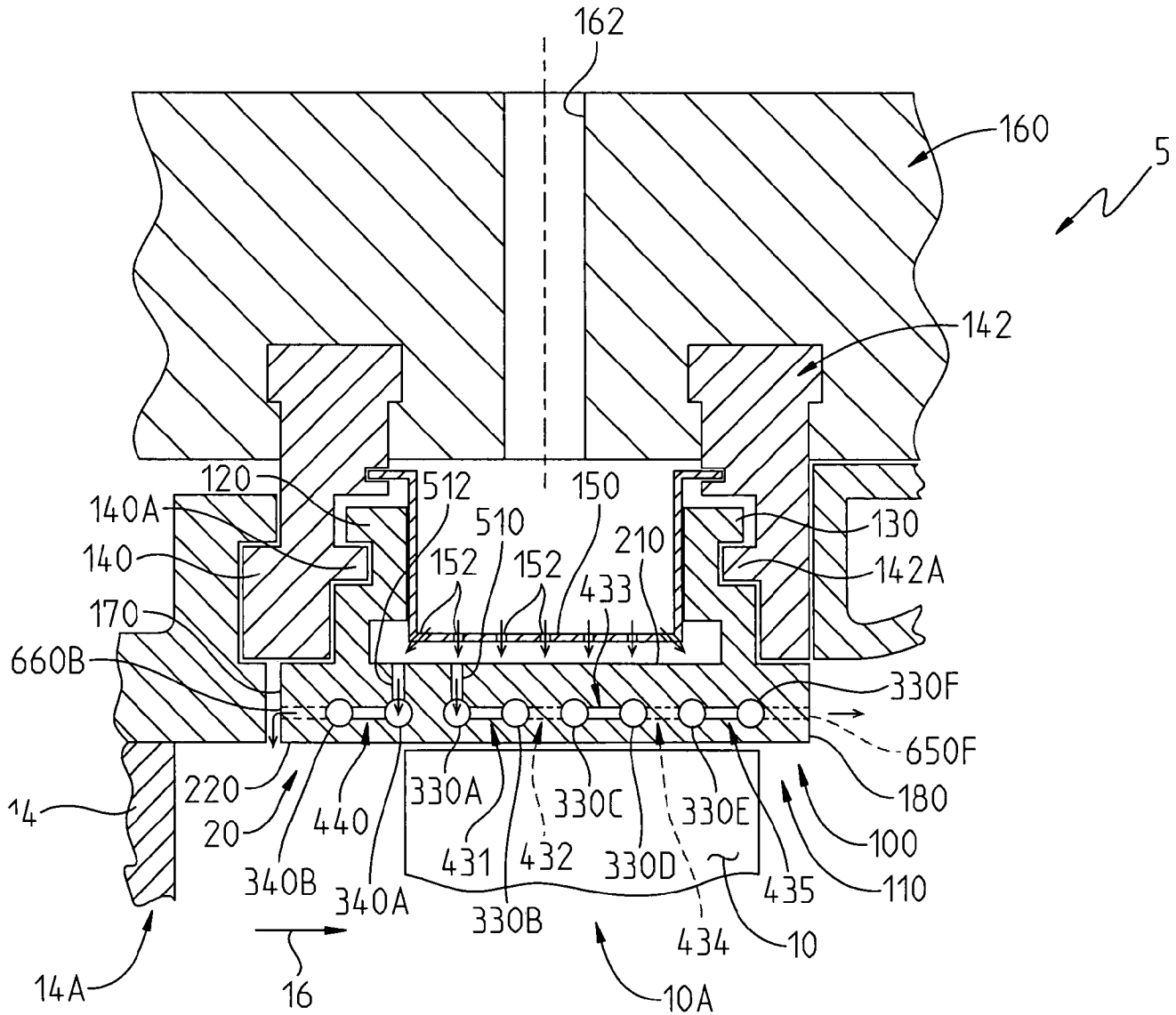
FIG. 1 is a cross sectional view of a portion of a gas turbine including an outer air seal structure constructed in accordance with a first embodiment of the present invention.

FIG. 1 illustrates in cross section a portion of a gas turbine 5 in a gas turbine engine. Within the turbine 5 are a series of rows of stationary vanes and rotating blades. In FIG. 1, a single blade 10 forming part of a single row 10A of blades is illustrated. Also illustrated in FIG. 1 is part of an upstream vane 14, forming part of a single row 14A of vanes. The blades are coupled to a shaft and disc assembly. Hot working gases from a combustor (not shown) in the engine travel to the rows of blades. In FIG. 1, the working gases travel to the row 10A of blades in the direction of arrow 16. As the working gases expand through the turbine 5, the working gases cause the blades, and therefore the shaft and disc assembly, to rotate.

In accordance with a first embodiment of the present invention, an outer air seal structure 20 is provided about and adjacent the row 10A of blades. The air seal structure 20 comprises a plurality of air seal units 100, which, when positioned side by side, define the air seal structure 20, see FIG. 2. The air seal structure 20 has a ring shape so as to extend circumferentially about its corresponding row 10A of blades. An air seal structure may be provided about each row of blades provided in the gas turbine 5. The air seal structure 20 comprises an inner wall of a turbine housing defining an inner cavity within the turbine housing in which the rotating blade rows are provided and defines sealing structure for preventing all or a substantial amount of the working gases from passing through the inner wall and reaching other structure of the turbine housing such as a blade ring carrier 160, see FIG. 1.

Figure 2:
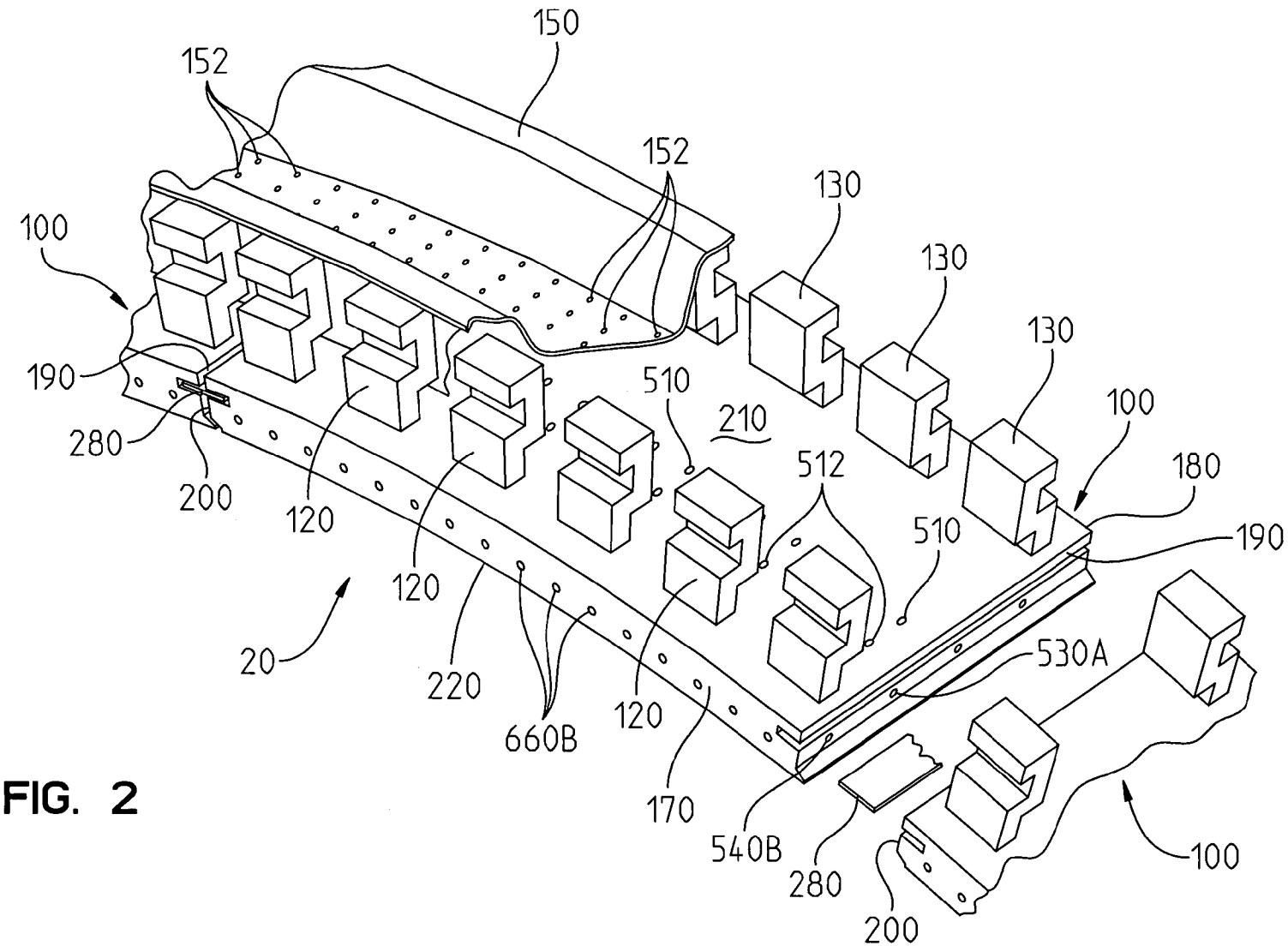
FIG. 2 is a perspective view of a portion of the outer air seal structure illustrated in FIG. 1.
Figure 3:
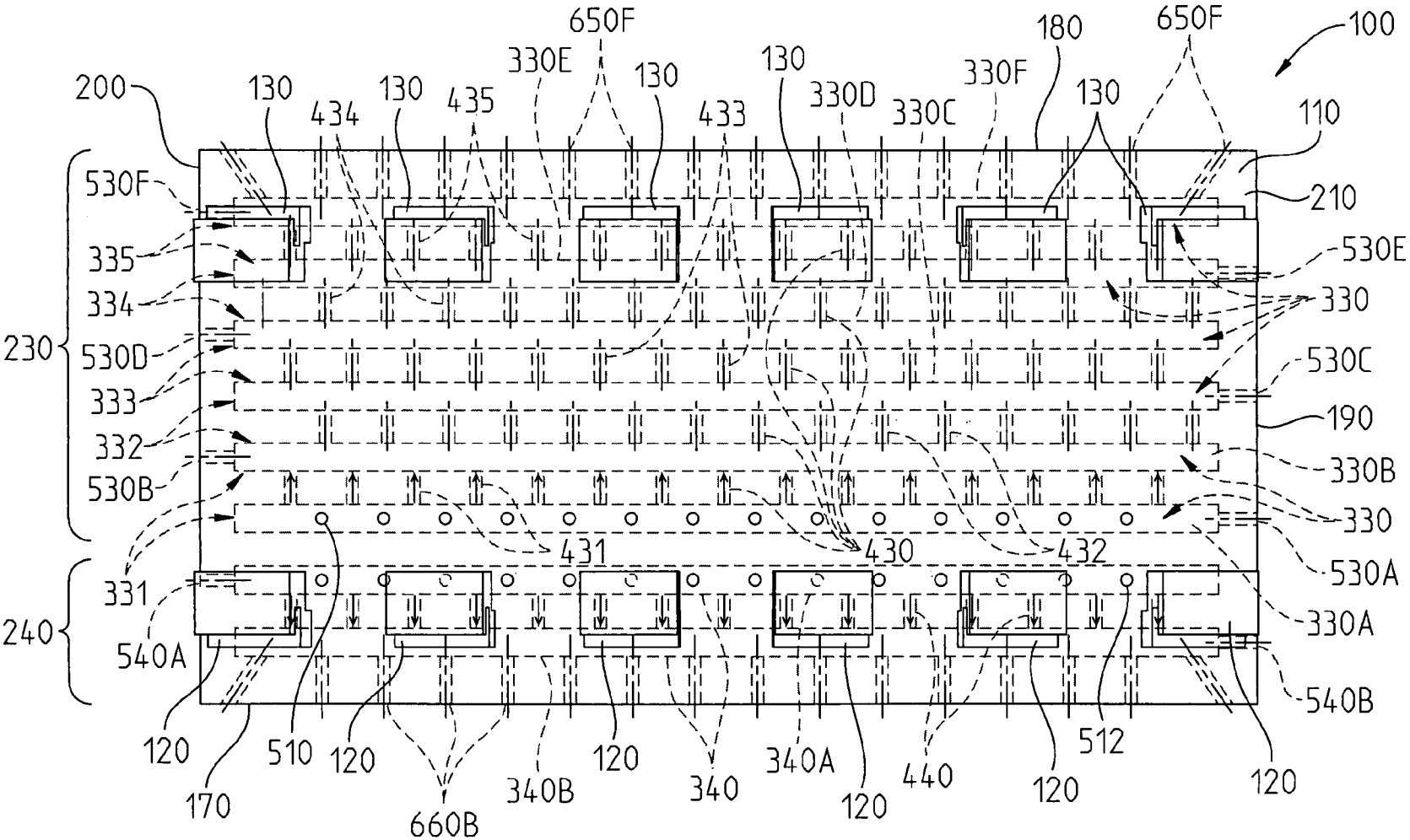
FIG. 3 is a plan view of an air seal unit forming part of the air seal structure illustrated in FIGS. 1 and 2.

Each air seal unit 100 comprises a main body 110, a plurality of front flanges or hooks 120 and a plurality of rear flanges or hooks 130, see FIGS. 1-3. The front and rear hooks 120 and 130 are formed with the main body 110 as an integral casting from a nickel-based alloy or like material. Each air seal unit 100 is mounted within the turbine 5 via corresponding front hooks 120 engaging an extension 140A of a first isolation ring structure 140 and corresponding rear hooks 130 engaging an extension 142A of a second isolation ring structure 142, see FIG. 1. An impingement tube structure 150 is also mounted to the first and second isolation ring structures 140, 142. The first and second isolation ring structures 140, 142 are mounted within the blade ring carrier 160 forming part of the gas turbine 5. The row 10A of blades rotate relative to the air seal structure 20, the first and second isolation ring structures 140, 142, the impingement tube structure 150 and the blade ring carrier 160. Hence, the air seal structure 20, the first and second isolation ring structures 140, 142, the impingement tube structure 150 and the blade ring carrier 160 are stationary within the turbine 5.

The main body 110 of each air seal unit 100 of the air seal structure 20 may be formed in the same manner. Hence, only a single main body 110 will be described herein.

The main body 110 comprises a front edge 170, a rear edge 180, first and second side edges 190 and 200, an upper surface 210 and a lower surface 220, see FIGS. 1-3. The front edge 170 faces the incoming hot working gases from the combustor (not shown) which, as noted above, travel in the direction of arrow 16 in FIG. 1. The lower surface 220 is positioned adjacent the first row 10A of blades, see FIG. 1.

In the embodiment illustrated in FIGS. 1-3, the main body 110 comprises first and second cooling zones 230 and 240. The first cooling zone 230 comprises a plurality of first impingement cavities 330 and a plurality of first interconnecting passages 430. The second cooling zone 240 comprises a plurality of second impingement cavities 340 and a plurality of second interconnecting passages 440.

In the embodiment illustrated in FIG. 3, there are first, second, third, fourth and fifth pairs 331-335 of the first impingement cavities 330. The first pair 331 of the first impingement cavities 330 comprises impingement cavities 330A and 330B; the second pair 332 of the first impingement cavities 330 comprises impingement cavities 330B and 330C; the third pair 333 of the first impingement cavities 330 comprises impingement cavities 330C and 330D; the fourth pair 334 of the first impingement cavities 330 comprises impingement cavities 330D and 330E; and the fifth pair 335 of the first impingement cavities 330 comprises impingement cavities 330E and 330F. Hence, the first and second pairs 331, 332 of the first impingement cavities 330 share a common impingement cavity 330B; the second and third pairs 332, 333 of the first impingement cavities 330 share a common impingement cavity 330C; the third and fourth pairs 333, 334 of the first impingement cavities 330 share a common impingement cavity 330D; and the fourth and fifth pairs 334, 335 of the first impingement cavities 330 share a common impingement cavity 330E.

A plurality of first cooling air supply bores 510 extend from the upper surface 210 of the main body 110 to the impingement cavity 330A of the first pair 331 of the first impingement cavities 330, see FIGS. 1-4. A portion of cooling air supplied from either a source external to the gas turbine engine or from a combustor (not shown) forming part of the gas turbine engine passes through a bore 162 in the blade ring carrier 160 and openings 152 in the impingement tube structure 150 into the first cooling air supply bores 510.

A first group 431 of the first interconnecting passages 430 extend between the first pair 331 of the first impingement cavities 330; a second group 432 of the first interconnecting passages 430 extend between the second pair 332 of the first impingement cavities 330; a third group 433 of the first interconnecting passages 430 extend between the third pair 333 of the first impingement cavities 330; a fourth group 434 of the first interconnecting passages 430 extend between the fourth pair 334 of the first impingement cavities 330; and a fifth group 435 of the first interconnecting passages 430 extend between the fifth pair 335 of the first impingement cavities 330.

The cooling air passing through the first cooling air supply bores 510 enters into the impingement cavity 330A. A portion of the cooling air passing through the impingement cavity 330A exits the cavity 330A through an exit 530A in the first side edge 190 of the main body 110. A remaining portion of the cooling air in the impingement cavity 330A passes through the first group 431 of the first interconnecting passages 430 into the impingement cavity 330B.

A portion of the cooling air passing through the impingement cavity 330B exits the cavity 330B through an exit 530B in the second side edge 200 of the main body 110. A remaining portion of the cooling air in the impingement cavity 330B passes through the second group 432 of the first interconnecting passages 430 into the impingement cavity 330C.

A portion of the cooling air passing through the impingement cavity 330C exits the cavity 330C through an exit 530C in the first side edge 190 of the main body 110. A remaining portion of the cooling air in the impingement cavity 330C passes through the third group 433 of the first interconnecting passages 430 into the impingement cavity 330D.

A portion of the cooling air passing through the impingement cavity 330D exits the cavity 330D through an exit 530D in the second side edge 200 of the main body 110. A remaining portion of the cooling air in the impingement cavity 330D passes through the fourth group 434 of the first interconnecting passages 430 into the impingement cavity 330E.

A portion of the cooling air passing through the impingement cavity 330E exits the cavity 330E through an exit 530E in the first side edge 190 of the main body 110. A remaining portion of the cooling air in the impingement cavity 330E passes through the fifth group 435 of the first interconnecting passages 430 into the impingement cavity 330F.

The cooling air passing through the impingement cavity 330F exits the impingement cavity through an exit 530F in the second side edge 200 of the main body 110 and a plurality of rear cooling bores 650F extending from the impingement cavity 330F to the main body rear edge 180. The rear cooling bores 650F are offset relative to the fifth group 435 of the first interconnecting passages 430.

So as to improve cooling of the main body 110, the second group 432 of the first interconnecting passages 430 within the main body 110 are staggered or offset relative to the first group 431 of the first interconnecting passages 430, see FIGS. 1 and 3. That is, the first interconnecting passages 430 in the second group 432 are positioned off axis relative to the first interconnecting passages 430 in the first group 431. Because the first interconnecting passages 430 of the first and second groups 431 and 432 are not aligned with one another, the cooling air moving from the impingement cavity 330A through the first group 431 of the first interconnecting passages 430 to the impingement cavity 330B exits the interconnecting passages 430 of the first group 431, enters the impingement cavity 330B and strikes a back wall 1330B define a part of the impingement cavity 330B, see FIG. 4. Since the cooling air strikes or impinges upon the back wall 1330B, an increase in convective heat transfer from the main body 110 to the cooling air is believed to occur as compared to when cooling air passes through a cavity or bore in a main body without directly impinging upon or striking a wall within the main body.

In a similar manner, the first interconnecting passages 430 of the third group 433 are staggered relative to the first interconnecting passages 430 of the second group 432; the first interconnecting passages 430 of the fourth group 434 are staggered relative to the first interconnecting passages 430 of the third group 433; and the first interconnecting passages 430 of the fifth group 435 are staggered relative to the first interconnecting passages 430 of the fourth group 434. Because adjacent groups of the first interconnecting passages 430 are staggered relative to one another, the cooling air passing through the first cooling zone 230 impinges upon and makes contact with numerous surfaces within the main body 110, resulting in enhanced heat transfer from the main body 110 to the cooling air. This is in contrast to prior art devices having generally straight bores extending through a main body of an air seal unit defining generally straight paths for cooling air to move through the main body. Because the cooling air impinges upon numerous walls and surfaces within the main body 110, convective heat transfer from the metal defining the main body 110 to the cooling air is believed to be enhanced.

Figure 4:
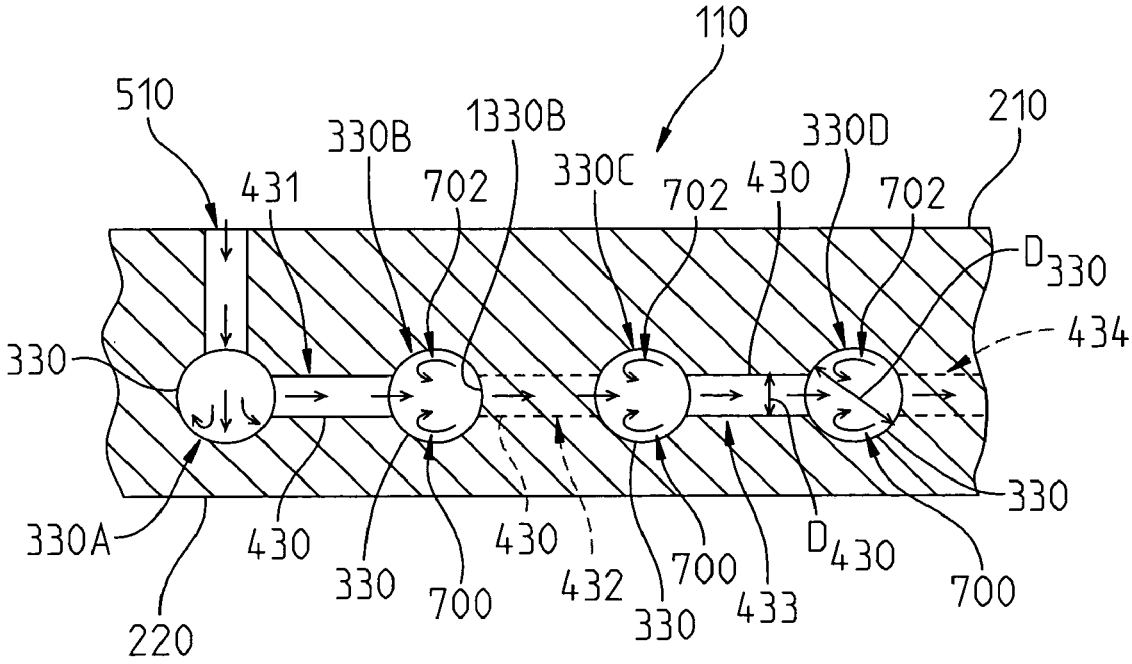
FIG. 4 is an enlarged cross sectional view of a portion of the air seal structure illustrated in FIG. 1.

As illustrated in FIG. 4, because a diameter $D_{430}$ of the first interconnecting passages 430 is less than a diameter $D_{330}$ of the first impingement cavities 330, a pair of side wall cooling air vortices 700 and 702 are formed in each first impingement cavity 330 in locations where a jet of cooling air enters the cavity 330 from an adjacent interconnecting passage 430. The vortices 700 and 702 are believed to enhance heat transfer from the main body 110 to the cooling air. It is contemplated, however, that the diameter $D_{430}$ of the first interconnecting passages 430 may be substantially equal to the diameter $D_{330}$ of the first impingement cavities 330.

Figure 4A:
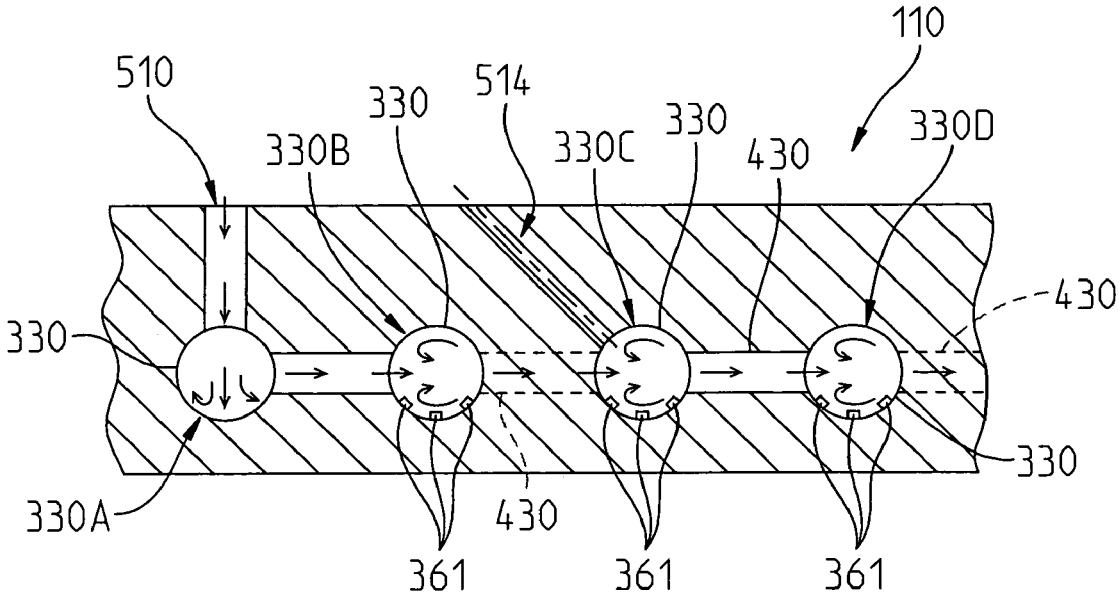
FIG. 4A is an enlarged cross sectional view of a portion of an air seal structure constructed in accordance with an alternative embodiment of the present invention.

In an alternative embodiment illustrated in FIG. 4A, a plurality of protrusions 361 are provided in impingement cavities 330B-330D. The protrusions 361 extend along substantially the entire length of a corresponding impingement cavity 330. The protrusions 361 provide a greater amount of surface area for the cooling air to contact as the cooling air moves through an impingement cavity 330, thereby enhancing heat transfer between the main body 110 and the cooling air.

In the embodiment illustrated in FIGS. 1-3, there is a single pair of the second impingement cavities 340A and 340B. The second interconnecting passages 440 extend between the impingement cavities 340A and 340B.

A plurality of second cooling air supply bores 512 extend from the upper surface 210 of the main body 110 to the second impingement cavity 340A. A portion of the cooling air passing through the bore 162 in the blade ring carrier 160 and the openings 152 in the impingement tube structure 150 passes into the second cooling air supply bores 512.

The cooling air passing through the second cooling air supply bores 512, enters into the impingement cavity 340A. A portion of the cooling air passing through the impingement cavity 340A exits the cavity 340A through an exit 540A in the second side edge 200 of the main body 110. A remaining portion of the cooling air in the impingement cavity 340A passes through the second interconnecting passages 4410 into the impingement cavity 340B. The cooling air passing through the impingement cavity 340B exits the impingement cavity 340B through an exit 540B in the first side edge 190 of the main body 110 and a plurality of front cooling bores 660B extending from the impingement cavity 340B to the main body front edge 170. The front cooling bores 660B are offset relative to the second interconnecting passages 440.

The pressure of the cooling air leaving the front cooling bores 660B must be sufficiently high to prevent hot working gases provided by the combustor and moving in the direction of arrow 16 in FIG. 1 from entering the front cooling bores 660B. The pressure of the cooling air leaving the rear cooling bores 650F, however, may be less due to the pressure of the working gases being lower on the backside of the blades 10. Hence, the number of second impingement cavities 340 is substantially less than the number of first impingement cavities 330 in the embodiment illustrated in FIGS. 1-3 since less of a cooling air pressure drop can occur within the second cooling zone 240 as compared to the first cooling zone 230.

Figure 5:
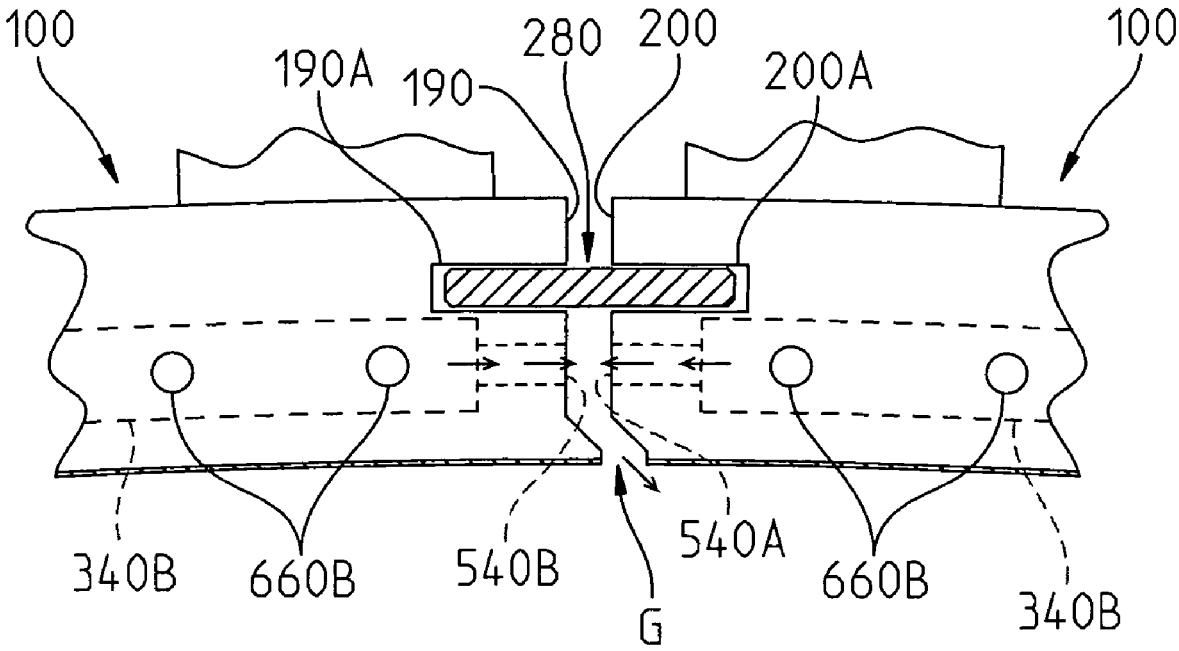
FIG. 5 is a view of first and second side edges of adjacent air seal units of the air seal structure illustrated in FIGS. 1 and 2.

The air seal structure 20 is constructed by positioning a plurality of air seal units 100 side by side such that a first side edge 190 of one air seal unit 100 is positioned adjacent to a second side edge 200 of another air seal unit 100, see FIGS. 2 and 5. A seal plate 280 is provided in recesses 190A and 200A in the first and second side edges 190 and 200 so as to prevent hot working gases from passing through the adjacent air seal units 100 and reaching the impingement tube structure 150. A gap G is provided between the side edges 190 and 200 of adjacent air seal units 100 to allow the cooling air leaving the main bodies 110 via the exits 530A-530F and 540A and 540B in the first and second side edges 190 and 200 to pass through the gap G and exit the air seal structure 20.

After the air seal structure 20 has been assembled within a turbine 5, one or more resupply bores 514 may be drilled from the upper surface 210 of the main body 110 to a desired impingement cavity 330, see FIG. 4A. The one or more resupply bores 514 provide additional cooling air to areas of the air seal structure 20 that are found to be in need of additional cooling, i.e., high temperature areas.

It is contemplated that the number of cooling zones provided within a main body of an air seal unit may vary. Further, the number and/or size of impingement cavities and interconnecting passages may vary from cooling zone to cooling zone within a single air seal unit.

Figure 6:
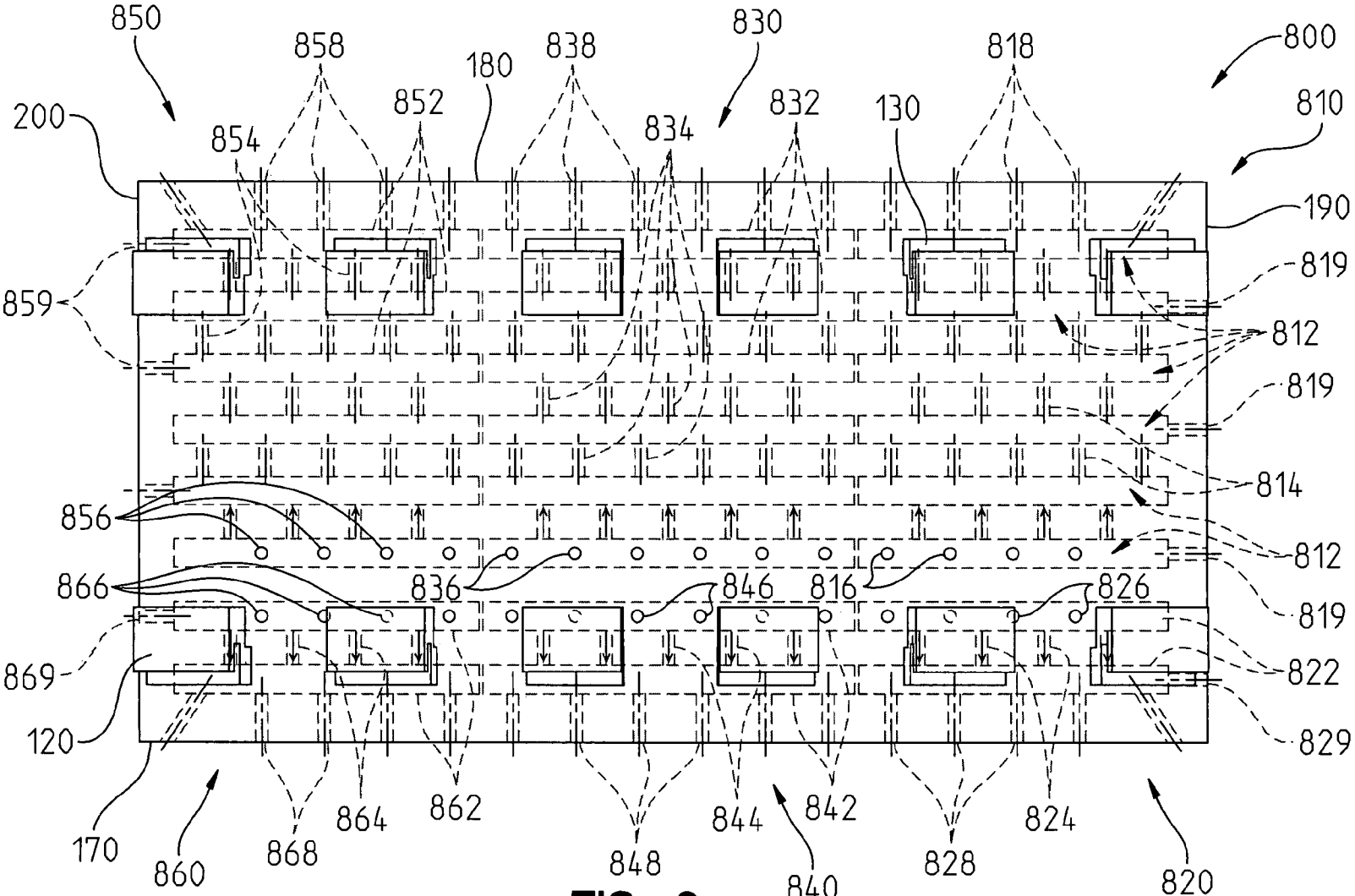
FIG. 6 is a plan view of an air seal unit formed in accordance with a second embodiment of the present invention.

A main body 800 constructed in accordance with a second embodiment of the present invention is illustrated in FIG. 6, where like reference numerals indicate like elements. In this embodiment, the main body 800 includes a first cooling zone 810, a second cooling zone 820, a third cooling zone 830, a fourth cooling zone 840, a fifth cooling zone 850 and a sixth cooling zone 860.

The first cooling zone 810 comprises a plurality of first impingement cavities 812 and a plurality of first interconnecting passages 814. The cooling air enters one of the first impingement cavities 812 via first air supply bores 816. The cooling air leaves the first cooling zone 810 via first rear cooling bores 818 in the rear edge 180 of the main body 800 and first exits 819 in the first side edge 190 of the main body 800.

The second cooling zone 820 comprises a plurality of second impingement cavities 822 and a plurality of second interconnecting passages 824. The cooling air enters one of the second impingement cavities 822 via second air supply bores 826. The cooling air leaves the second cooling zone 820 via first front cooling bores 828 in the front edge 170 of the main body 800 and a second exit 829 in the first side edge 190 of the main body 800.

The third cooling zone 830 comprises a plurality of third impingement cavities 832 and a plurality of third interconnecting passages 834. The cooling air enters one of the third impingement cavities 832 via third air supply bores 836. The cooling air leaves the third cooling zone 830 via second rear cooling bores 838 in the rear edge 180 of the main body 800.

The fourth cooling zone 840 comprises a plurality of fourth impingement cavities 842 and a plurality of fourth interconnecting passages 844. The cooling air enters one of the fourth impingement cavities 842 via fourth air supply bores 846. The cooling air leaves the fourth cooling zone 840 via second front cooling bores 848 in the front edge 170 of the main body 800.

The fifth cooling zone 850 comprises a plurality of fifth impingement cavities 852 and a plurality of fifth interconnecting passages 854. The cooling air enters one of the fifth impingement cavities 852 via fifth air supply bores 856. The cooling air leaves the fifth cooling zone 850 via third rear cooling bores 858 in the rear edge 180 of the main body 800 and first exits 859 in the second side edge 200 of the main body 800.

The sixth cooling zone 860 comprises a plurality of sixth impingement cavities 862 and a plurality of sixth interconnecting passages 864. The cooling air enters one of the sixth impingement cavities 862 via sixth air supply bores 866. The cooling air leaves the sixth cooling zone 860 via third front cooling bores 868 in the front edge 170 of the main body 800 and a second exit 869 in the second side edge 200 of the main body 800.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An air seal unit adapted to be positioned adjacent blade structure in a gas turbine comprising:

a main body having a front edge, a rear edge, first and second side edges, an upper surface and a lower surface, said lower surface being adapted to be positioned adjacent blade structure in a gas turbine, said main body including a plurality of first impingement cavities and at least one first interconnecting passage extending between and communicating with a first pair of said first impingement cavities, said first interconnecting passage being nonparallel to said first pair of said first impingement cavities and defining a path for cooling air to pass from one of said first pair of said first impingement cavities to another of said first pair of said first impingement cavities so as to strike a wall defining at least a part of said other of said first pair of said first impingement cavities;

said at least one first interconnecting passage comprising a plurality of first interconnecting passages, a first group of said first interconnecting passages extend between said first pair of said first impingement cavities and a second group of said first interconnecting passages extend between a second pair of said first impingement cavities, said second pair of said first impingement cavities including an impingement cavity from said first pair of said first impingement cavities; and wherein said first group of said first interconnecting passages are staggered relative to said second group of said first interconnecting passages.

2. An air seal unit as set out in claim 1, further comprising at least one cooling air supply bore communicating with said one first impingement cavity.

3. An air seal unit as set out in claim 1, wherein said first interconnecting passages are generally perpendicular to said first impingement cavities.

4. An air seal unit as set out in claim 1, wherein said first impingement cavities and said first interconnecting passages are located in a first cooling zone of said main body, and said main body further comprising a second cooling zone.

5. An air seal unit as set out in claim 4, wherein said second cooling zone comprises a plurality of second impingement cavities and at least one second interconnecting passage extending between and communicating with a pair of said second impingement cavities.

6. An air seal unit as set out in claim 1, wherein alternating ones of said first impingement cavities extend to and have exits at said first side edge of said main body while the remaining ones of said first impingement cavities between said alternating ones extend to and have exits at said second side edge of said main body.

7. An air seal unit as set out in claim 1, wherein said first interconnecting passage has a diameter which less than a diameter of each of said first impingement cavities.

8. An air seal unit as set out in claim 1, further comprising a plurality of rear cooling bores extending from one of said first impingement cavities to said main body rear edge.

9. A gas turbine including rotatable blade structure and an outer air seal structure positioned about and adjacent said blade structure, said air seal structure comprising a plurality of air seal units, at least one of said units comprising:

a main body having a front edge, a rear edge, first and second side edges, an upper surface and a lower surface, said lower surface being adapted to be positioned adjacent said blade structure, said main body comprising first and second cooling zones, said first cooling zone including a plurality of first impingement cavities and a plurality of first interconnecting passages and said second cooling zone including a plurality of second impingement cavities and a plurality of second interconnecting passages, at least one of said first interconnecting passages extending between and communicating with a first pair of said first impingement cavities and at least one of said second interconnecting passages extending between and communicating with a first pair of said second impingement cavities, said one of said first interconnecting passages being nonparallel to said first pair of said first impingement cavities and said one of said second interconnecting passages being nonparallel to said first pair of said second impingement cavities;

a first group of said first interconnecting passages extend between said first pair of said first impingement cavities and a second group of said first interconnecting passages extend between a second pair of said first impingement cavities, said second pair of said first impingement cavities including an impingement cavity from said first pair of said first impingement cavities; and wherein said first group of said first interconnecting passages are staggered relative to said second group of said first interconnecting passages.

10. A gas turbine as set out in claim 9, further comprising at least one first cooling air supply bore communicating with one of said first impingement cavities and at least one second cooling air supply bore communicating with one of said second impingement cavities.

11. A gas turbine as set out in claim 9, wherein said first and second interconnecting passages are generally perpendicular to said first and second impingement cavities.

12. A gas turbine as set out in claim 9, wherein at least one of said first interconnecting passages has a diameter which is less than a diameter of each of said first impingement cavities.

13. A gas turbine as set out in claim 9, wherein a number of said first impingement cavities does not equal a number of said second impingement cavities.

14. A gas turbine as set out in claim 9, wherein a size of each of said first impingement cavities is different from a size of each of said second impingement cavities.

15. A gas turbine as set out in claim 9, wherein alternating ones of said first impingement cavities extend to and have exits at said first side edge of said main body while the remaining ones of said first impingement cavities between said alternating ones extend to and have exits at said second side edge of said main body.

16. A gas turbine as set out in claim 9, further comprising at least one resupply bore extending from said upper surface of said main body to one of said first impingement cavities.

17. A gas turbine as set out in claim 9, further comprising a plurality of front cooling bores extending from one of said second impingement cavities to said main body front edge and a plurality of rear cooling bores extending from one of said first impingement cavities to said main body rear edge.

18. A gas turbine including rotatable blade structure located in a path of hot working gases traveling in a flow direction, and an outer air seal structure positioned about and adjacent said blade structure, said air seal structure comprising a plurality of air seal units, at least one of said units comprising:

a main body having a front edge at an upstream location of the main body relative to the flow direction, a rear edge at a downstream location of the main body relative to the flow direction, first and second side edges, an upper surface and a lower surface, said lower surface being adapted to be positioned adjacent said blade structure, said main body comprising first and second cooling zones;

said first cooling zone located adjacent to said rear edge and including a plurality of first impingement cavities, and a plurality of first interconnecting passages extending between and communicating with pairs of said first impingement cavities, said first interconnecting passages being nonparallel to said pairs of said first impingement cavities;

said second cooling zone located adjacent to said front edge and including a plurality of second impingement cavities and a plurality of second interconnecting passages extending between and communicating with at least one pair of said second impingement cavities, said second interconnecting passages being nonparallel to said at least one pair of said second impingement cavities;

a plurality of first cooling air supply bores extending from said upper surface of said main body to at least one of said first impingement cavities to supply cooling air to said first cooling zone, and a plurality of rear cooling bores located at said rear edge of said main body for cooling air to exit said first cooling zone into the hot working gases adjacent to a backside of the blade structure;

a plurality of second cooling air supply bores extending from said upper surface of said main body to at least one of said second impingement cavities to supply cooling air to said second cooling zone, and a plurality of front cooling bores located at said front edge of said main body for cooling air to exit said second cooling zone into the hot working gases; and wherein a number of said first impingement cavities is greater than a number of said second impingement cavities.

19. A gas turbine as set out in claim 18, including first and second pairs of said first impingement cavities, said second pair of said first impingement cavities including an impingement cavity from said first pair of said first impingement cavities, wherein a first group of said first interconnecting passages extend between said first pair of said first impingement cavities and a second group of said first interconnecting passages extend between a second pair of said first impingement cavities, said first group of said first interconnecting passages being staggered relative to said second group of said first interconnecting passages.

20. A gas turbine as set out in claim 18, wherein said first interconnecting passages have a diameter which less than a diameter of each of said first impingement cavities, and said second interconnecting passages have a diameter which less than a diameter of each of said second impingement cavities.

* * * * *